US010589486B2

(12) United States Patent
Oude Grotebevelsborg

(10) Patent No.: US 10,589,486 B2
(45) Date of Patent: Mar. 17, 2020

(54) DEVICE AND METHOD FOR PRESSING ORGANIC MATERIAL OUT OF WASTE

(71) Applicant: ANAERGIA B.V.

(72) Inventor: Willem Jan Oude Grotebevelsborg, Ootmarsum (NL)

(73) Assignee: ANAERGIA B.V., Oldenzaal (NL)

( * ) Notice: Subject to any disclaimer, the term of this patent is extended or adjusted under 35 U.S.C. 154(b) by 0 days.

(21) Appl. No.: 15/027,885

(22) PCT Filed: Aug. 28, 2014

(86) PCT No.: PCT/NL2014/000026
§ 371 (c)(1),
(2) Date: Apr. 7, 2016

(87) PCT Pub. No.: WO2015/053617
PCT Pub. Date: Apr. 16, 2015

(65) Prior Publication Data

US 2016/0236435 A1 Aug. 18, 2016

(30) Foreign Application Priority Data

Oct. 13, 2013 (NL) ..... 1040442

(51) Int. Cl.
*B30B 9/30* (2006.01)
*B30B 9/06* (2006.01)

(52) U.S. Cl.
CPC ..... *B30B 9/3039* (2013.01); *B30B 9/06* (2013.01); *B30B 9/067* (2013.01); *B30B 9/301* (2013.01);
(Continued)

(58) Field of Classification Search
CPC .... B30B 9/02; B30B 9/04; B30B 9/06; B30B 9/065; B30B 9/067; B30B 9/301;
(Continued)

(56) References Cited

U.S. PATENT DOCUMENTS 1,014,893 A 1/1912 Henry
1,328,259 A 1/1920 Barbet
(Continued)

FOREIGN PATENT DOCUMENTS

CA 1117851 A 2/1982
CA 2343832 A1 10/2002
(Continued)

OTHER PUBLICATIONS

Chinese Patent Application No. 201480062263.3, Office Action dated Jun. 12, 2017 with English Translation.
(Continued)

*Primary Examiner* — Jimmy T Nguyen

(57) ABSTRACT

Device (100) for pressing organic material out of waste, comprising: —a pressing chamber (3) and a first pressing member (4) for compacting introduced waste; —a first feed opening (5) for feeding waste into the pressing chamber (4); —perforations (6) for allowing air, moisture and organic material pressed out of introduced waste to escape from the pressing chamber (3), which perforations (6) are arranged in a wall (9) of the pressing chamber (3) and debouch in a surface (7) bounding the pressing chamber (3); and —a discharge opening (8) for discharging from the pressing chamber (3) compacted waste from which air, moisture and organic material are at least partially removed and whereby the surface lies perpendicularly of the pressing direction of the first pressing member (4). Pressing perpendicularly of the surface (7) results in a more effective and efficient pressing. The device (100) preferably also comprises: —a second feed opening (2) for feeding waste into the device (100); and —an infeed chamber (13), which infeed chamber (13) is located between the first feed opening (5) and the second feed opening (2). A pre-compaction takes place during the displacement of waste fed into the infeed chamber (13) to the pressing chamber (3) via the first feed
(Continued)

opening (5), this still further increasing the effectiveness, efficiency and yield of the pressing. Also method for pressing organic material out of waste by means of such a device.

12 Claims, 7 Drawing Sheets

(52) U.S. Cl.
CPC ..... *B30B 9/3014* (2013.01); *B30B 9/3021* (2013.01); *B30B 9/3028* (2013.01); *B30B 9/3078* (2013.01)

(58) Field of Classification Search
CPC ... B30B 9/3021; B30B 9/3028; B30B 9/3003; B30B 9/3014; B30B 9/3039; B30B 9/3078; B30B 9/3096
USPC ..... 100/110, 215, 218, 232
See application file for complete search history.

(56) References Cited

U.S. PATENT DOCUMENTS 2,000,444 A 5/1935 Hechenbleikner
2,289,953 A 7/1942 Aldridge
2,854,827 A 10/1958 Lockerbie et al.
2,937,506 A 5/1960 Stirlen
3,255,887 A 6/1966 Walker et al.
3,365,860 A 1/1968 Boris
3,451,185 A * 6/1969 Kunitoshi ..... B30B 9/3078 100/3
3,491,682 A 1/1970 Nils et al.
3,517,732 A 6/1970 Robert
3,618,905 A 11/1971 Primus
3,858,504 A 1/1975 Boyer
3,864,440 A 2/1975 Giocoechea
4,036,356 A 7/1977 Reist
4,036,359 A * 7/1977 Strickland, Jr. ..... B30B 9/3039 100/37
4,098,690 A 7/1978 Semmens
4,162,147 A 7/1979 Haverkamp
4,198,359 A 4/1980 Todd
4,294,812 A 10/1981 Oler
4,343,233 A 8/1982 Burgin
4,414,103 A 11/1983 Farrell
4,417,510 A 11/1983 Sharp
4,477,341 A 10/1984 Schweiss et al.
4,594,942 A * 6/1986 Denneboom ..... B30B 9/3078 100/137
4,613,431 A 9/1986 Miller
4,618,462 A 10/1986 Fisher
4,650,546 A 3/1987 Le Jeune
4,691,628 A 9/1987 Simpson
4,770,748 A 9/1988 Cellini et al.
4,861,524 A 8/1989 Sielaff et al.
4,880,504 A 11/1989 Cellini et al.
5,030,362 A 7/1991 Da Silva et al.
5,146,848 A * 9/1992 Dufour ..... B30B 9/067 100/110
5,273,572 A 12/1993 Baker et al.
5,400,726 A 3/1995 Dumons
5,458,789 A 10/1995 Dickerson et al.
5,593,590 A 1/1997 Steyskal
5,863,444 A 1/1999 Murphy et al.
6,139,601 A 10/2000 Wernimont
6,149,887 A 11/2000 Lagas et al.
6,162,284 A 12/2000 Mitchell et al.
6,178,822 B1 1/2001 Manning
6,178,882 B1 * 1/2001 Wagner ..... B09B 3/0058 100/240
6,299,774 B1 10/2001 Ainsworth et al.
6,368,849 B1 4/2002 Norddahl
6,383,544 B1 5/2002 Elkins
6,409,788 B1 6/2002 Sower
6,464,875 B1 10/2002 Woodruff
6,569,332 B2 5/2003 Ainsworth et al.
6,682,578 B2 1/2004 Sower
6,692,642 B2 2/2004 Josse et al.
6,715,743 B2 4/2004 Zhang
6,838,069 B2 1/2005 Blonigen et al.
6,846,343 B2 1/2005 Sower
6,866,779 B1 3/2005 Burke
6,916,426 B2 7/2005 Van Slyke et al.
6,920,983 B2 7/2005 Gabl
6,984,323 B2 1/2006 Khudenko
7,014,768 B2 3/2006 Li et al.
7,153,427 B2 12/2006 Burke
7,204,967 B2 4/2007 Bierle et al.
7,416,644 B2 8/2008 Bonde
7,731,850 B2 6/2010 Choi et al.
7,806,957 B1 10/2010 Burke
7,814,826 B2 * 10/2010 Ribas-Blanes ..... B30B 9/3003 100/126
7,927,491 B2 4/2011 Kotelko et al.
8,470,567 B2 6/2013 Facey et al.
8,603,336 B2 12/2013 Frommann et al.
9,045,355 B2 6/2015 Kumar et al.
2001/0004063 A1 6/2001 Oh
2001/0033816 A1 10/2001 Blonigen et al.
2002/0134254 A1 9/2002 Sebright et al.
2002/0158024 A1 10/2002 Van Slyke et al.
2003/0084693 A1 5/2003 Sower
2003/0201225 A1 10/2003 Josse et al.
2004/0164021 A1 8/2004 Li et al.
2005/0047995 A1 3/2005 Wylie
2005/0139546 A1 6/2005 Burke
2006/0006055 A1 1/2006 Bonde
2007/0048212 A1 3/2007 Bierle et al.
2007/0141691 A1 6/2007 Hirl
2007/0297953 A1 12/2007 Kemp et al.
2008/0053909 A1 3/2008 Fassbender
2008/0053913 A1 3/2008 Fassbender
2008/0152571 A1 6/2008 Hu et al.
2008/0156709 A1 7/2008 Johnson
2008/0156726 A1 7/2008 Fassbender
2008/0302722 A1 12/2008 Burke
2009/0014377 A1 1/2009 Janssen et al.
2009/0095673 A1 4/2009 Choate et al.
2009/0206028 A1 8/2009 Jiang et al.
2010/0065250 A1 3/2010 Frommann
2010/0170845 A1 7/2010 Baur et al.
2010/0187182 A1 7/2010 Vago
2010/0218573 A1 9/2010 Van Slyke
2011/0091954 A1 4/2011 Chen et al.
2012/0122194 A1 5/2012 Dumons
2014/0033776 A1 2/2014 Josse et al.
2014/0144195 A1 5/2014 Callendrello et al.
2014/0157846 A1 6/2014 Jeppson et al.
2014/0314657 A1 10/2014 Zhao et al.
2017/0334739 A1 11/2017 Theodoulou et al.

FOREIGN PATENT DOCUMENTS

CA 2381623 A1 10/2002
CA 2416690 A1 7/2004
CA 2416690 C 8/2008
CA 2799408 A1 11/2011
CH 655048 A5 3/1986
CN 201841684 U 5/2011
DE 2726233 A1 12/1978
DE 2841015 A1 4/1980
DE 8103406 U1 4/1981
DE 4444032 C1 5/1996
DE 102008007818 A1 8/2009
EP 0468852 A1 1/1992
EP 0468853 A1 1/1992
EP 0494561 A1 7/1992
EP 0494154 B1 9/1995
EP 1215187 A2 6/2002
EP 1273393 A2 1/2003
EP 1173325 B1 7/2003
EP 1568478 A1 8/2005
EP 2014455 A1 1/2009

(56) References Cited

FOREIGN PATENT DOCUMENTS

| | | | |
|---|---|---|---|
| EP | 2335914 | A2 | 6/2011 |
| EP | 2344284 | B1 | 8/2016 |
| FR | 2510474 | A1 | 2/1983 |
| FR | 2615443 | A1 | 11/1988 |
| FR | 2677579 | A1 | 12/1992 |
| GB | 710383 | A | 6/1954 |
| GB | 2139610 | A | 11/1984 |
| GB | 2383034 | A | 6/2003 |
| IT | TO20111068 | A1 | 5/2013 |
| JP | S5533900 | A | 3/1980 |
| WO | 9942423 | A1 | 8/1999 |
| WO | 2009011906 | A1 | 1/2009 |
| WO | 2010096899 | A1 | 9/2010 |
| WO | 2010097177 | A1 | 9/2010 |
| WO | 2011156767 | A2 | 12/2011 |
| WO | 2012109737 | A1 | 8/2012 |
| WO | 2013091094 | A1 | 6/2013 |
| WO | 2014094162 | A1 | 6/2014 |

OTHER PUBLICATIONS

Chinese Patent Application No. 201480062263.3, Office Action dated Oct. 9, 2016—with English Translation.
International Patent Application No. PCT/NL2014/000026, International Preliminary Report on Patentability dated Apr. 28, 2016.
International Patent Application No. PCT/NL2014/000026, International Search Report and Written Opinion dated Dec. 5, 2014.
Netherland Patent Application No. 1040442, Search Report dated Apr. 16, 2014—No English Translation Available.
Office Action for Canadian Application No. 20142926816 dated May 1, 2017.
Chinese Patent Application No. 201480062263.3, Office Action dated Dec. 13, 2017.
English translation of Office Action dated Dec. 13, 2017 on Chinese Patent Application No. 201480062263.3.
European Patent Application No. 16177423.7, European Search Report dated Dec. 5, 2016.
U.S. Appl. No. 14/684,127, Non-Final Office Action dated Jan. 26, 2018.
U.S. Appl. No. 15/475,028, Non-Final Office Action dated Jan. 25, 2018.
Chinese Patent Application No. 201480062263.3, Office Action dated Jul. 9, 2018.
Ammonia Recovery Process, http://www.thermoenergy.com/water-technologies/, retrieved on line 2011, 1 page.
Bonmati et al., "Air Stripping of Ammonia From Pig Slurry: Characterisation and Feasibility as a Pre- or Post-Treatment to Mesophilic Anaerobic Digestion," Waste Management, 2003, vol. 23 (3), pp. 261-272.
Canadian Patent Application No. 2,826,025, Office Action dated Jul. 3, 2018.
Canadian Patent Application No. 2,826,025, Office Action dated Oct. 16, 2017.
Canadian Patent Application No. 2,926,816, Office Action dated Dec. 11, 2018.
Cast Systems, www.thermoenergy.com/water-technologies/technologies . . . , 2011, retrieved from the Internet Nov. 2, 2011, 1 Page.
CASTion Corporation, A Thermo Energy Company, "Ammonia Removal in Municipal Sludge Dewatering Centrate," Pilot Test Results on Centrate, Dec. 1, 2008, 16 Pages.
Constantine, "An Overview of Ammonia and Nitrogen Removal in Wastewater Treatment", CH2M Hill Canada, Feb. 19, 2008.
Constantine, "North American Experience with Centrate Treatment Technologies for Ammonia and Nitrogen Removal," WEFTEC Conference, 2006, pp. 5271-5281.
Dhaliwal et al., "Distillation of Ammonia from Water and Wastewater," Water Pollution Control Federation, Oct. 1985, vol. 57 (10), pp. 1036-1039.
EPA, "Wastewater Technology Fact Sheet Ammonia Stripping," United States Environmental Protection Agency, Sep. 2000, 4 pages.
European Patent Application No. 12746463.4, Examination Report dated Jun. 21, 2018.
European Application No. 12860692, Supplementary European Search Report dated Jul. 16, 2015.
European Application No. 13866334.9, Supplementary Partial European Search Report dated Feb. 20, 2017.
European Application No. 13866334.9, Supplementary Partial European Search Report dated Oct. 21, 2016.
European Patent Application No. 12746463.4 Communication pursuant to Rule 70(2) and 70a(2) EPC dated Jul. 7, 2017.
European Patent Application No. 12746463.4, Extended European Search Report dated Jun. 21, 2017.
European Patent Application No. 12860692.8, Office Action dated Dec. 12, 2016.
European Patent Application No. 12860692.8, Office Action dated Jan. 4, 2018.
European Patent Application No. 12860692.8, Office Action dated Jan. 16, 2018.
European Patent Application No. 15857098.6, Extended European Search Report dated Jun. 6, 2018.
Fernandez-Seara et al., "Distillation Column Configurations in Ammonia-Water Absorption Refrigeration Systems," International Journal of Refrigeration, Jan. 2003, vol. 26 (1), pp. 28-34.
Groth et al., English Language Abstract of DE4444032 entitled "Manure treatment in two stages, to release ammonia and concentrate slurry", published May 2, 1996, 1 page.
International Patent Application No. PCT/CA2012/000144, International Preliminary Report on Patentability dated Aug. 29, 2013.
International Patent Application No. PCT/CA2012/000144, International Search Report dated Jul. 10, 2012.
International Patent Application No. PCT/CA2012/050907, International Preliminary Report on Patentability dated Jul. 3, 2014.
International Patent Application No. PCT/CA2012/050907, International Search Report dated Mar. 25, 2013.
International Patent Application No. PCT/CA2013/050985, International Preliminary Report on Patentability dated Jul. 2, 2015.
International Patent Application No. PCT/CA2013/050985, International Search Report and Written Opinion dated Apr. 24, 2014.
International Patent Application No. PCT/CA2015/051154, International Search Report and Written Opinion dated Jan. 25, 2016.
Jorgensen et al., "Ammonia Removal from Wastewater by Ion Exchange in the Presence of Organic Contaminants," Water Research, 2003, vol. 37, pp. 1723-1728.
Oilgae, "New Technologies in Ammonia Removal from Wastewater", http://www.oilge.com/algae/cult/sew/new/amm/amm.html, retrieved online Dec. 14, 2011, 10 Pages.
Orentlicher et al., "Savings from Integration of Centrate Ammonia Reduction with BNR Operation: Simulation of Plant Operation," ThermoEnergy Corporation, HydroQual Inc., undated, 25 pages, http://web2.uconn.edu/seagrantnybight/documents/nutrient%20docs/Orentlicher%20Savings%20Integration%20Centrate%20Ammonia%20Reduction.pdf.
Thermoenergy, Ammonia Removal and Recovery Systems for Industrial Wastewater Treatment, http://www.thermoenergy.com/water-technologies/industrial-solutions/ammonia-removal . . . , retrieved online Dec. 14, 2011, 2 Pages.
U.S. Appl. No. 14/684,127, Final Office Action dated Sep. 20, 2018.
U.S. Appl. No. 14/934,780, Notice of Allowance dated Dec. 13, 2018.
U.S. Appl. No. 15/475,028, Final Office Action dated Sep. 21, 2018.
U.S. Appl. No. 15/524,886, Non Final Office Action dated Feb. 20, 2019.
U.S. Appl. No. 14/934,780, Non-Final Office Action dated Jul. 26, 2018.
U.S. Appl. No. 15/209,293, Non-Final Office Action dated May 14, 2018.
U.S. Appl. No. 13/823,404, Final Office Action dated Feb. 9, 2016.
U.S. Appl. No. 13/823,404, Office Action dated Feb. 13, 2015.
U.S. Appl. No. 13/823,404, Office Action dated May 21, 2015.
U.S. Appl. No. 13/982,585, Office Action dated Dec. 14, 2015.

(56) References Cited

OTHER PUBLICATIONS

U.S. Appl. No. 13/982,585, Office Action dated Sep. 18, 2015.
U.S. Appl. No. 14/652,615, Final Office Action dated Jun. 7, 2017.
U.S. Appl. No. 14/652,615, Notice of Allowance dated Jul. 21, 2017.
U.S. Appl. No. 14/652,615, Office Action dated Feb. 10, 2017.
U.S. Appl. No. 14/934,780, Non-Final Office Action dated Dec. 15, 2017.
U.S. Appl. No. 14/934,780, Notice of Allowance dated Apr. 5, 2018.
U.S. Appl. No. 14/934,780, Restriction Requirement dated Sep. 14, 2017.
U.S. Appl. No. 15/209,293, Final Office Action dated Dec. 14, 2018.
U.S. Appl. No. 15/209,293, Restriction Requirement dated Feb. 16, 2018.
U.S. Appl. No. 15/360,574, Final Office Action dated Oct. 31, 2018.
U.S. Appl. No. 15/360,574, Non-Final Office Action dated Feb. 8, 2018.
U.S. Appl. No. 15/360,574, Notice of Allowance dated Dec. 12, 2018.
Written Opinion for Application No. ITTO20111068, dated Apr. 26, 2012, 9 pages.
Written Opinion for Application No. PCT/CA2012/000144, dated Jul. 10, 2012, 5 pages.
Written Opinion for Application No. PCT/CA2012/050907, dated Mar. 25, 2013, 10 pages.
Chinese Patent Application No. 201480062263.3, Office Action dated May 8, 2019.
U.S. Appl. No. 15/475,028, Non-Final Office Action dated Jul. 23, 2019.
U.S. Appl. No. 14/684,127, Non-Final Office Action dated Jul. 23, 2019.
Canadian Patent Application No. 2,926,816, Office Action dated Oct. 4, 2019.
Chinese Patent Application No. 201480062263.3, Office Action dated Aug. 22, 2019.
Chinese Patent Application No. 201480062263.3, Office Action dated Jan. 9, 2020—English Translation Not Available.
Indian Patent Application No. 201617014280, Office Action dated Dec. 31, 2019.
United Kingdom Patent Application No. 1608258.8, Examination Report dated Dec. 3, 2019.
U.S. Appl. No. 14/684,127, Final Office Action dated Jan. 3, 2020.
U.S. Appl. No. 15/475,028, Final Office Action dated Jan. 8, 2020.

* cited by examiner

DEVICE AND METHOD FOR PRESSING ORGANIC MATERIAL OUT OF WASTE

CROSS-REFERENCE TO RELATED APPLICATIONS

This application is a National Stage Entry of International Application No. PCT/NL2014/000026, filed Aug. 28, 2014, which claims priority to NL Application Serial No. 1040442, filed Oct. 13, 2013. International Application No. PCT/NL2014/000026 is incorporated by reference.

FIELD OF THE INVENTION

The invention relates to a device for pressing organic material out of waste, comprising:

- a pressing chamber and a first pressing member for compacting introduced waste;
- a first feed opening for feeding waste into the pressing chamber;
- perforations for allowing air, moisture and organic material pressed out of introduced waste to escape from the pressing chamber, which perforations are arranged in a wall of the pressing chamber and debouch in a surface bounding the pressing chamber; and
- a discharge opening for discharging from the pressing chamber compacted waste from which air, moisture and organic material are at least partially removed.

The invention also relates to a method for pressing organic material out of waste by means of such a device.

BACKGROUND OF THE INVENTION

Household refuse consists mainly of packaging material; glass, paper, plastic and tin; food remnants; wastepaper; garden waste; and other waste such as broken lamps, empty batteries, broken toys and diverse other superfluous articles. Among other materials domestic waste comprises plastic, mainly PE, PP and PVC; organic material such as food remnants and garden waste; water present particularly in the organic material; paper, cardboard packaging, drink packs and old newspapers; metal such as tin and aluminium, but also for instance copper from appliances; glass such as broken glasses, jars and light bulbs; and textiles such as old clothing.

The following are often collected separately: paper and cardboard waste; glass waste; household hazardous waste (HHW or red waste); kitchen and garden waste (KGW or green waste); plastic bottles, metal and drink packaging (PMD or blue waste); textile waste; small appliances and electric household equipment (white goods), sound and vision electronics (brown goods) and ICT equipment (grey goods); and residual waste (grey waste), this being all other domestic waste. Paper and cardboard waste, glass waste, HHW, KGW, PMD, textile waste, and white, brown and grey goods can be wholly or partially recycled. Paper and cardboard waste and KGW are sometimes also incinerated. The residual waste (grey waste) can be incinerated or dumped. It can then for instance first be shredded, wherein waste bags are opened and the residual waste is reduced in size, after which for instance ferromagnetic materials are removed with a magnet and light plastic objects are blown out of the waste with air. The residual waste and KGW can for instance also be put together and composted.

The organic material can also be processed by digestion. For this purpose it must first be separated from the waste, household waste or residual waste. A suitable method herefor is pressing. The waste is fed here into a pressing chamber and compacted by means of a pressing member, for instance an auger or a plunger. At a sufficiently high pressure the cell walls break and the moisture enclosed in the cells is released. The consistency of the organic material hereby changes from more solid to more pasty and more liquid. Air, moisture and organic material leave the pressing chamber via discharge channels, gaps or perforations provided for the purpose. The remaining compacted material is removed from the pressing chamber by means of a method suitable for the purpose.

Described in NL7203727A is an example of pressing of organic material from waste with a plunger as pressing member, wherein the waste is fed by means of the same plunger into a pressing chamber and the remaining material is also removed again by means of this same plunger from the pressing chamber via a tube with an open outer end. The maximum pressing force is however limited here and the plunger always has to make a relatively large stroke. Found in EP0091365A1 is another example of pressing of organic material from waste with a first plunger as pressing member with which the waste is again also fed into a pressing chamber, and wherein the remaining material is now removed from the pressing chamber by means of a second plunger via a discharge opening provided for this purpose. Here too, the first plunger always has to make a relatively large stroke. The construction of the device, and in particular the relative placing of the components thereof, also limits the maximum pressing forces. U.S. Pat. No. 5,146,848A describes a pressing device for recovering liquid present in containers, comprising two plungers lying mutually in line and operating in mutually opposite directions. Both plungers have to be able here to supply the great force required for pressing out the relevant material, and this with a relatively large stroke, which makes the device costly and complex. U.S. Pat. No. 6,178,882B1 describes a device with the same function, though now with two plungers moving mutually perpendicularly of each other. The first plunger again compacts the relevant material and the waste is again fed with this first plunger into a pressing chamber while the compacted material is again removed from the pressing chamber by means of the second plunger. It is here also the case that the first plunger always has to make a relatively large stroke, and that the construction of the device, and particularly the relative placing of the components thereof, limits the maximum pressing forces.

Said known devices thus have in each case one or both of the following drawbacks: (1) the plunger which compacts the material, and so has to deliver great forces and therefore takes a heavy form, must make a relatively large stroke, this making the device costly and complex and limiting the processing speed, and (2) the construction of the device, and in particular the relative placing of the components thereof, limits the maximum pressing forces. It is more generally the case that known devices and methods for pressing organic material out of waste, household waste or residual waste, also have many other drawbacks in respect of effectiveness, efficiency and yield, robustness, durability, energy consumption, susceptibility to malfunction, wear, maintenance and the costs of production, exploitation and maintenance. The present invention now provides a solution which does not have the stated drawbacks, or at least does so to lesser extent.

SUMMARY OF THE INVENTION

The invention provides a device for pressing organic material out of waste having a pressing chamber and a first pressing member for compacting introduced waste, a first feed opening for feeding waste into the pressing chamber, and perforations for allowing air, moisture and organic material pressed out of introduced waste to escape from the pressing chamber. The perforations are arranged in a wall of the pressing chamber and debouch in a surface bounding the pressing chamber. The surface lies perpendicularly of the pressing direction of the first pressing member. The devices also has a discharge opening for discharging from the pressing chamber compacted waste from which air, moisture and organic material are at least partially removed. The invention also provides a method for pressing organic material out of waste by means of a device having a pressing chamber and a first pressing member for compacting introduced waste, a first feed opening for feeding waste into the pressing chamber, perforations for allowing air, moisture and organic material pressed out of introduced waste to escape from the pressing chamber which perforations are arranged in a wall of the pressing chamber and debouch in a surface bounding the pressing chamber and a discharge opening for discharging from the pressing chamber compacted waste from which air, moisture and organic material are at least partially removed. The method has steps of feeding waste via the first feed opening into the pressing chamber, compacting introduced waste in the pressing chamber by means of the first pressing member, allowing air, moisture and organic material pressed out of introduced waste to escape from the pressing chamber via the perforations and discharging compacted waste from the pressing chamber via the discharge opening, characterized in that pressing takes place perpendicularly of the surface by means of the first pressing member. The term 'perpendicularly' is understood in the context of the invention to mean 'at least substantially perpendicularly'. Pressing perpendicularly of the surface results in a more effective and efficient pressing. Perforations can also be arranged here in the first pressing member. The effectiveness, the efficiency and the yield of the pressing can be increased still further by arranging the perforations in both the fixed wall and the first pressing member. The first pressing member preferably comprises a first plunger. Using a plunger, in contrast to for instance an auger, the pressure in the pressing chamber and the compacted material can be properly controlled and a high pressure can be readily realized.

The device preferably also comprises a second pressing member, more preferably a second plunger, for discharging compacted waste from the pressing chamber through the discharge opening. The pressing direction of the second pressing member preferably lies perpendicularly of the pressing direction of the first pressing member and the cross-section of the second pressing member is the same as the cross-section of the discharge opening. The term 'the same' is understood in the context of the invention to mean 'at least substantially the same'. The term 'cross-section' is understood here to mean 'the active cross-section perpendicularly of the direction of movement'. It is thus found that the discharge of compacted material can take place simply and optimally with the smallest possible chance of malfunctions, for instance due to larger pieces of solid material becoming jammed in the device.

The device preferably also comprises:

a second feed opening for feeding waste into the device; and an infeed chamber, which infeed chamber is located between the first feed opening and the second feed opening.

In a first extreme position of the first pressing member the infeed chamber can be situated here between the pressing surface of the first pressing member and the first feed opening. Waste fed into the infeed chamber can then be displaced by means of the first pressing member via the first feed opening to the pressing chamber and there subsequently compacted by means of the first pressing member. In a first extreme position of the second pressing member the infeed chamber can also be situated between the pressing surface of the second pressing member and the first feed opening. Waste fed into the infeed chamber can then be displaced by means of the second pressing member via the first feed opening to the pressing chamber and there subsequently compacted by means of the first pressing member. The term 'pressing surface' is understood in the context of the invention to mean 'the part of the periphery exerting pressure on the relevant material during pressing or displacement'. 'Between the pressing surface of a pressing member and a feed opening' is understood here to mean 'between a first plane in which the pressing surface lies and a second plane in which the feed opening lines'. A pre-compaction takes place during the displacement of waste fed into the infeed chamber to the pressing chamber via the first feed opening, this still further increasing the effectiveness, efficiency and yield of the pressing.

BRIEF DESCRIPTION OF THE DRAWINGS

The invention is elucidated hereinbelow on the basis of non-limitative exemplary embodiments. More or less schematically in the drawings.

EXEMPLARY EMBODIMENTS

Figure 1:
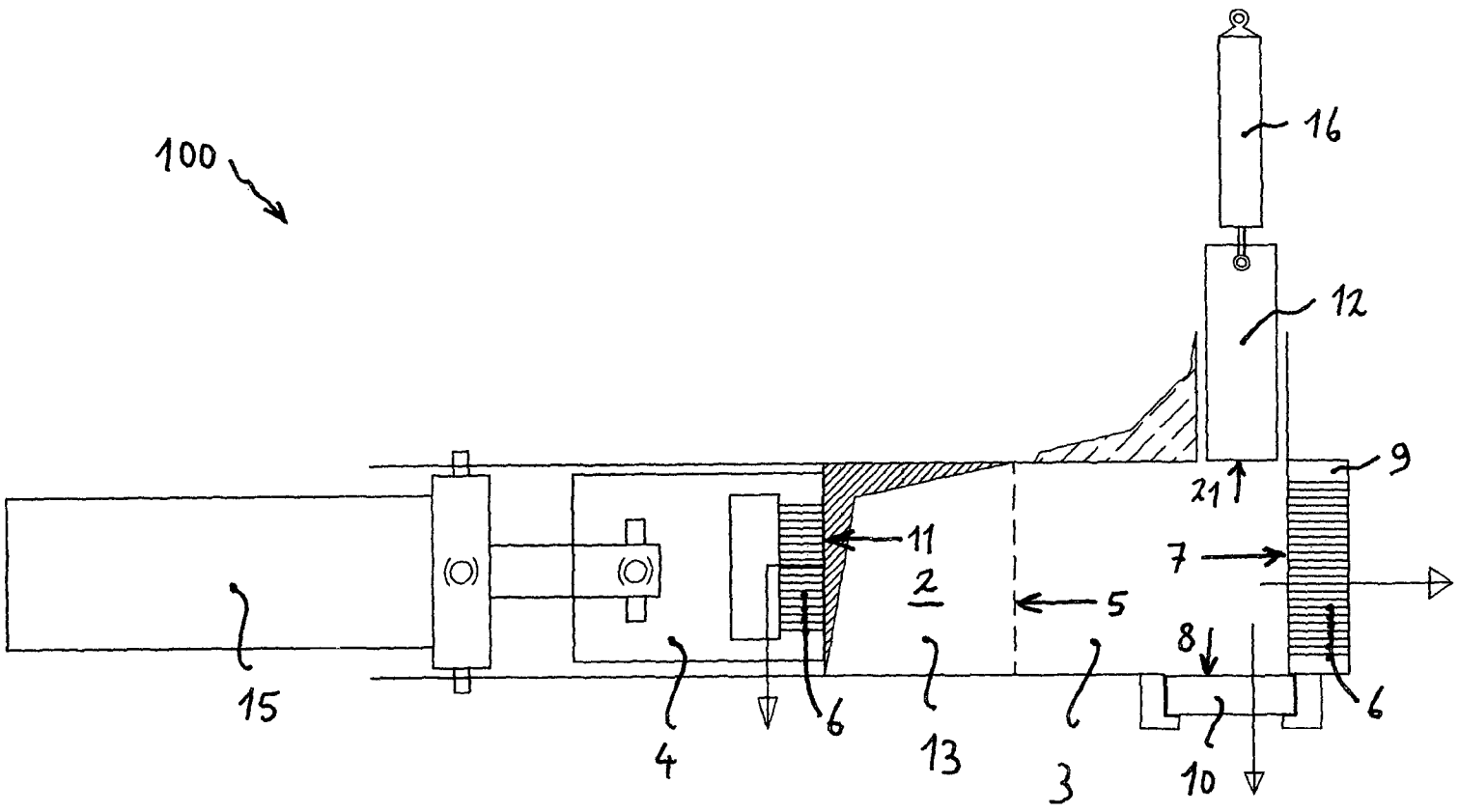
FIG. 1 shows a horizontal longitudinal section of a first exemplary embodiment of a device according to the invention.
Figure 2:
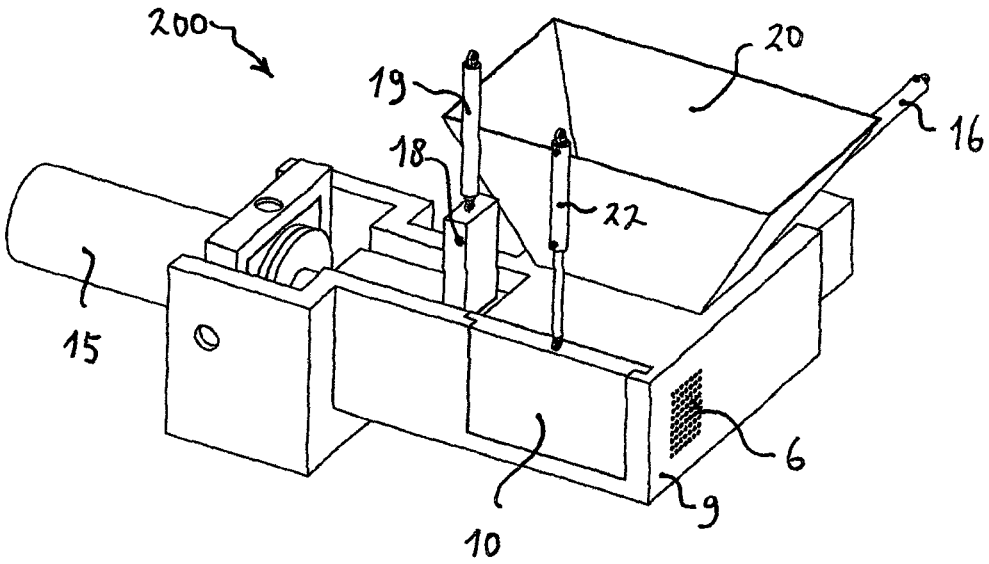
FIG. 2 shows a perspective view of a second exemplary embodiment of a device according to the invention.
Figure 3:
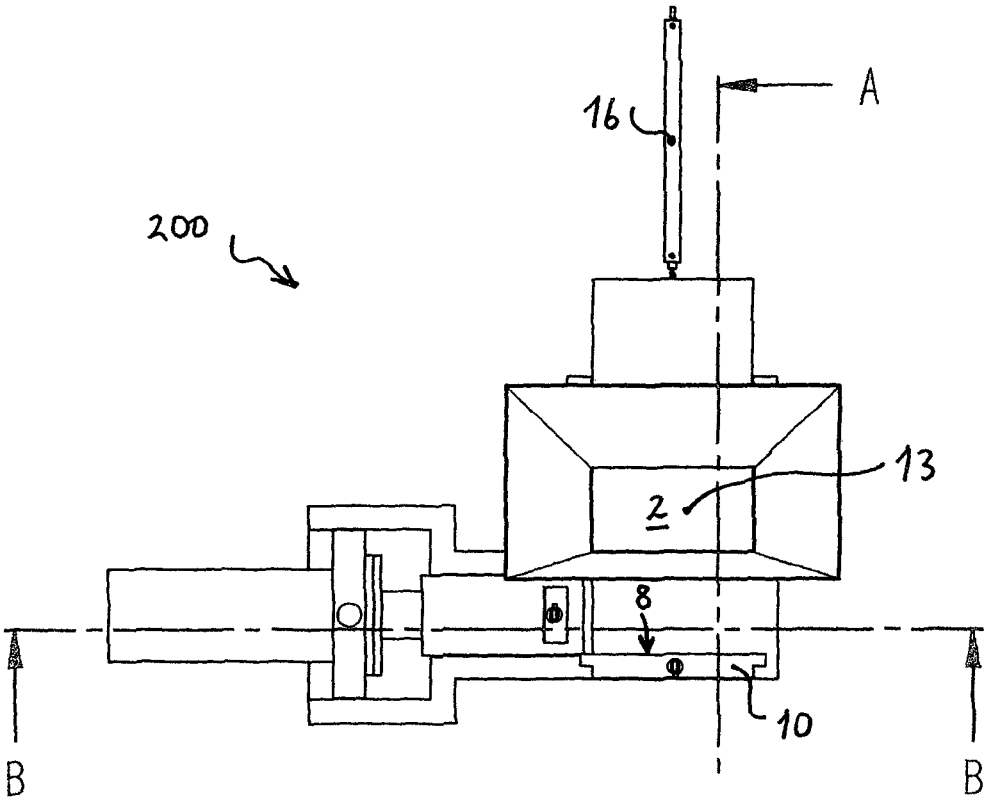
FIG. 3 is a top view of the device shown in FIG. 2.
Figure 4:
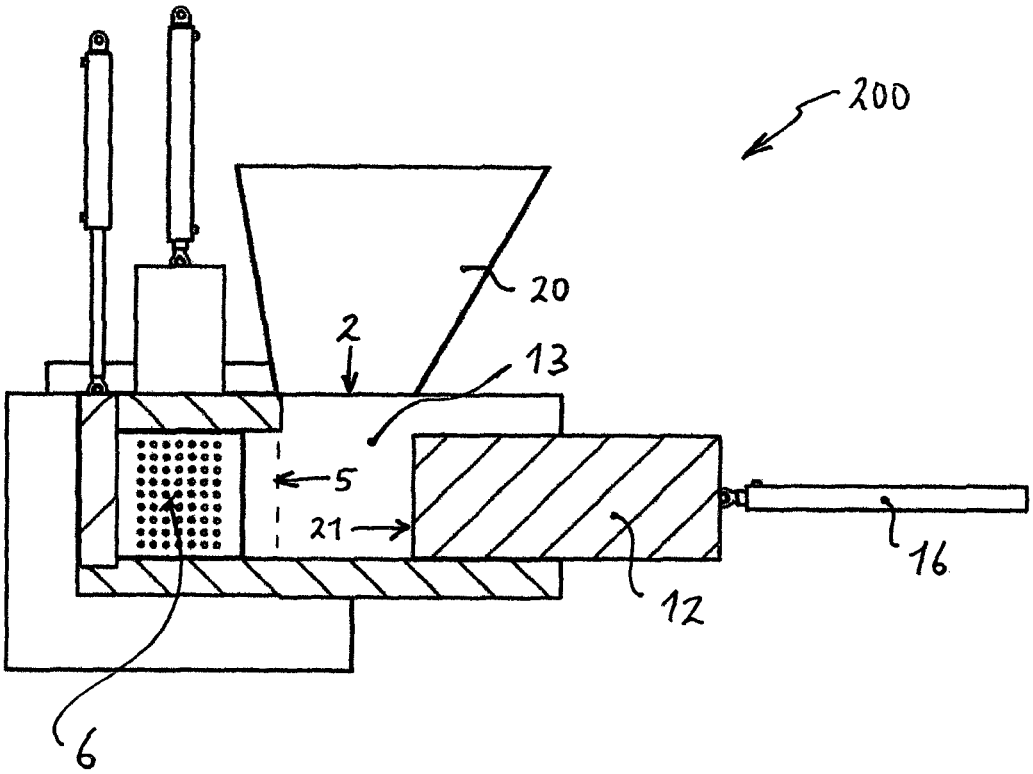
FIG. 4 is a vertical section of the device shown in FIG. 2 along the plane A-A.

The device (100) shown in FIG. 1 comprises a second feed opening (2) for feeding waste into device (100), an infeed chamber (13), a pressing chamber (3) and a first pressing member, here a first plunger (4), for compacting introduced waste, and a first feed opening (5) for feeding waste into pressing chamber (3). In order to allow air, moisture and organic material pressed out of introduced waste to escape from pressing chamber (3) perforations (6) are arranged in a wall (9) of pressing chamber (3). Perforations (6) debouch in a surface (7) bounding pressing chamber (3). Characteristic is the position of this surface (7) perpendicularly of the pressing direction of first pressing member (4). Perforations (6) are also arranged in first plunger (4).

First plunger (4) is movable between two extreme positions by means of a drive, here a first hydraulic cylinder (15). In the first extreme position (shown in FIG. 1) infeed chamber (13) is situated between pressing surface (11) of first plunger (4) and first feed opening (5). The waste to be compacted can now be fed via the second feed opening (2) into device (100). First plunger (4) can be moved (to the right in FIG. 1) to the second extreme position in which pressing surface (11) is situated in pressing chamber (3) (not shown) and first plunger (4) closes second feed opening (2). In this movement the waste to be compacted is fed into pressing chamber (3) via first feed opening (5), pre-compacted and further compacted in pressing chamber (3).

Device (100) also comprises a discharge opening (8) for discharging compacted waste from pressing chamber (3). Discharge opening (8) can be closed by means of a first door, here a sliding door (10). Device (100) also comprises a second pressing member, here a second plunger (12), movable by means of a drive, here a second hydraulic cylinder (16), for discharging compacted waste out of pressing chamber (3) through discharge opening (8). The pressing direction of second plunger (12) lies perpendicularly here of the pressing direction of first plunger (4). Second plunger (12) is movable between two extreme positions, a first extreme position (shown in FIG. 1) in which pressing surface (21) is situated just outside pressing chamber (3) and bounds pressing chamber (3), and a second extreme position (not shown) wherein pressing surface (21) is situated at the position of discharge opening (8). In the movement from the first extreme position to the second extreme position material compacted in pressing chamber (3), following opening of sliding door (10), is discharged from pressing chamber (3) via discharge opening (8).

The device (200) shown in FIGS. 2-5 again comprises a second feed opening (2), provided here with a hopper (20), for feeding waste into device (200), an infeed chamber (13), a pressing chamber (3) and a first pressing member, here again a first plunger (4), for compacting introduced waste, a first feed opening (5) for feeding waste into pressing chamber (3), and a second pressing member, here again a second plunger (12), for discharging compacted waste from pressing chamber (3) through a discharge opening (8). The pressing direction of second plunger (12) again lies perpendicularly here of the pressing direction of first plunger (4). In order to allow air, moisture and organic material pressed from introduced waste to escape from pressing chamber (3) perforations (6) are once again arranged in a wall (9) of pressing chamber (3) and in first plunger (4). Second feed opening (2), first feed opening (5) and infeed chamber (13) are however now situated at other locations.

First plunger (4) is again movable by means of a drive, here again a first hydraulic cylinder (15), again between two extreme positions. In the first extreme position (shown in FIG. 5) the pressing surface (11) is now situated just outside the pressing chamber (3) and pressing surface (11) bounds pressing chamber (3). In the second extreme position (not shown) the pressing surface (11) is again situated inside pressing chamber (3). In the movement from the first extreme position to the second extreme position the introduced waste is compacted in pressing chamber (3). The stroke made my first plunger (4) is now minimal, which has advantages in respect of for instance simplicity of construction, processing capacity, wear and the space and energy required.

Discharge opening (8) can again be closed by means of a first door, here again a sliding door (10), driven here by means of a third hydraulic cylinder (22). Second plunger (12) is again movable between two extreme positions. In a first extreme position (shown in FIG. 4) infeed chamber (13) is now situated between pressing surface (21) of second plunger (12) and first feed opening (5). The waste to be compacted can again now be fed via second feed opening (2) into device (200). In an intermediate position between the two extreme positions (not shown) pressing surface (21) is situated at the position of first feed opening (5). In the movement from the first extreme position to the intermediate position waste to be compacted is now carried by means of second plunger (12) via first feed opening (5) into pressing chamber (3) and thereby pre-compacted. The introduced waste can now be compacted by means of first plunger (4) wherein pressing surface (21) of second plunger (12) bounds pressing chamber (3). In the second extreme position (not shown) of second plunger (12) the pressing surface (21) is again situated at the position of discharge opening (8). In the movement from the intermediate to the second extreme position material compacted in pressing chamber (3) is once again discharged via discharge opening (8) out of pressing chamber (3) following opening of sliding door (10). The position of second plunger (12) in the intermediate position has to be well-defined. This is possible for instance by fixing second plunger (12) in this intermediate position within the applicable tolerances by means of a locking (not shown) provided for this purpose, for instance in the form of pins and receiving spaces co-acting therewith. The extreme positions of plungers (4,12) are in principle easier to define, for instance by having the plungers (4,12) come up against stops provided for this purpose in the extreme positions, this in a manner as will be apparent to a skilled person.

Figure 5:
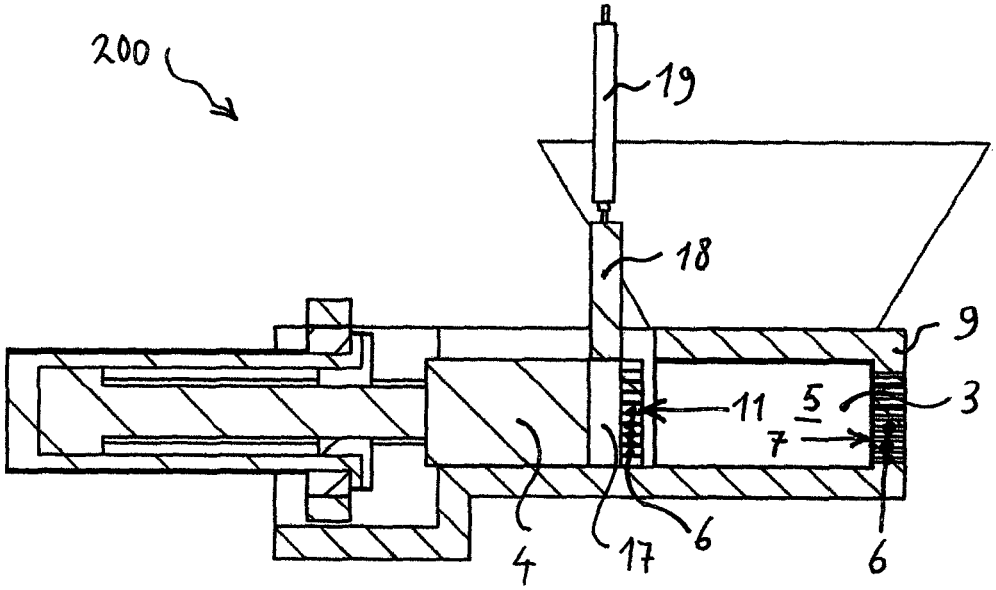
FIG. 5 is a vertical section of the device shown in FIG. 2 along the plane B-B.
Figure 6:
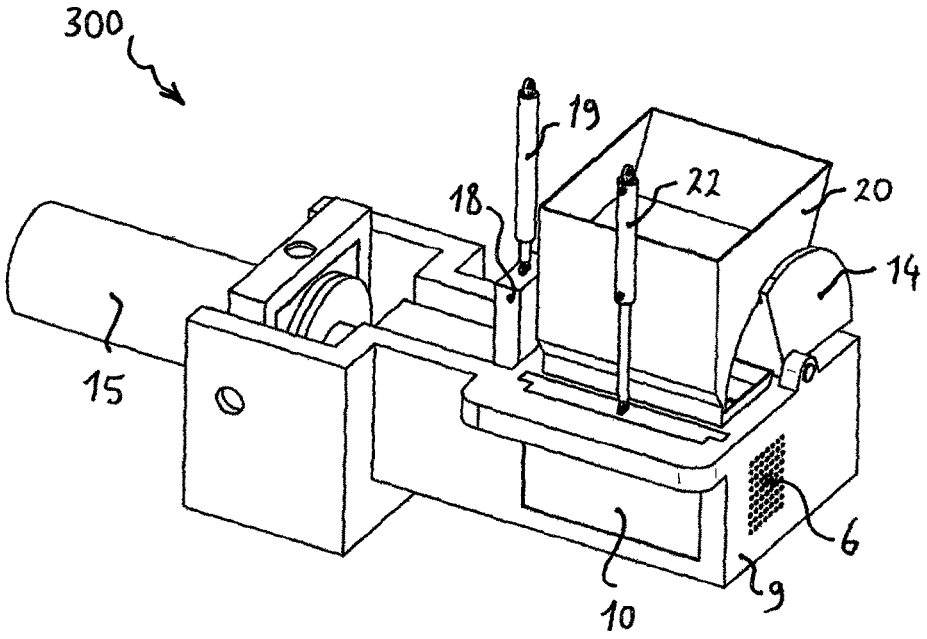
FIG. 6 shows a perspective view of a third exemplary embodiment of a device according to the invention.
Figure 7:
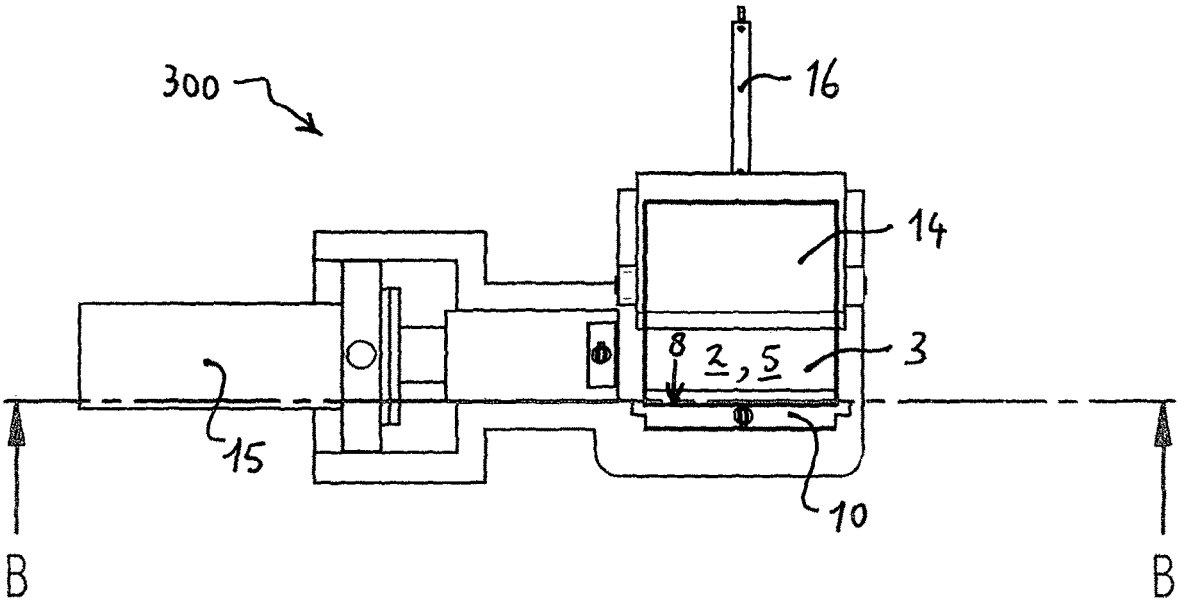
FIG. 7 is a top view of the device shown in FIG. 6.
Figure 8:
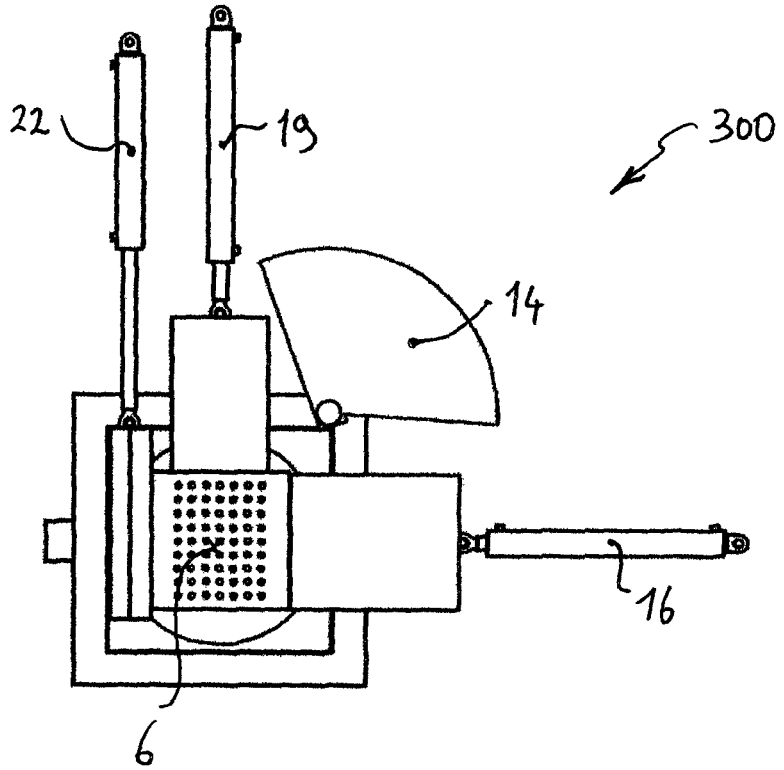
FIG. 8 is a side view of the device shown in FIG. 6.
Figure 9:
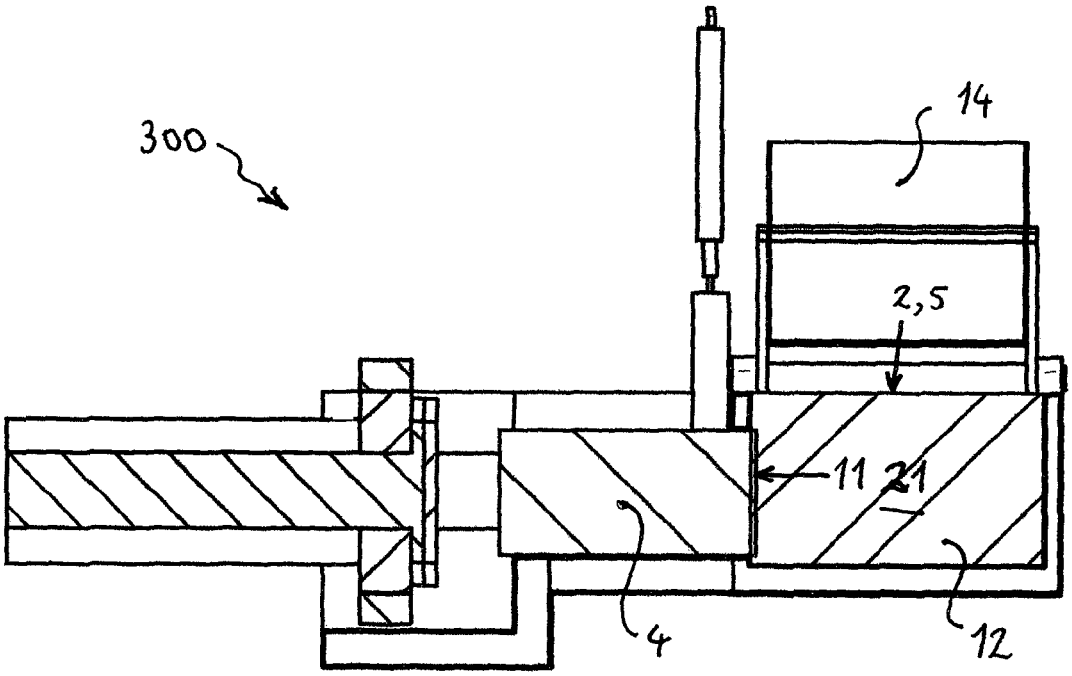
FIG. 9 is a vertical section of the device shown in FIG. 6 along the plane B-B.
Figure 10:
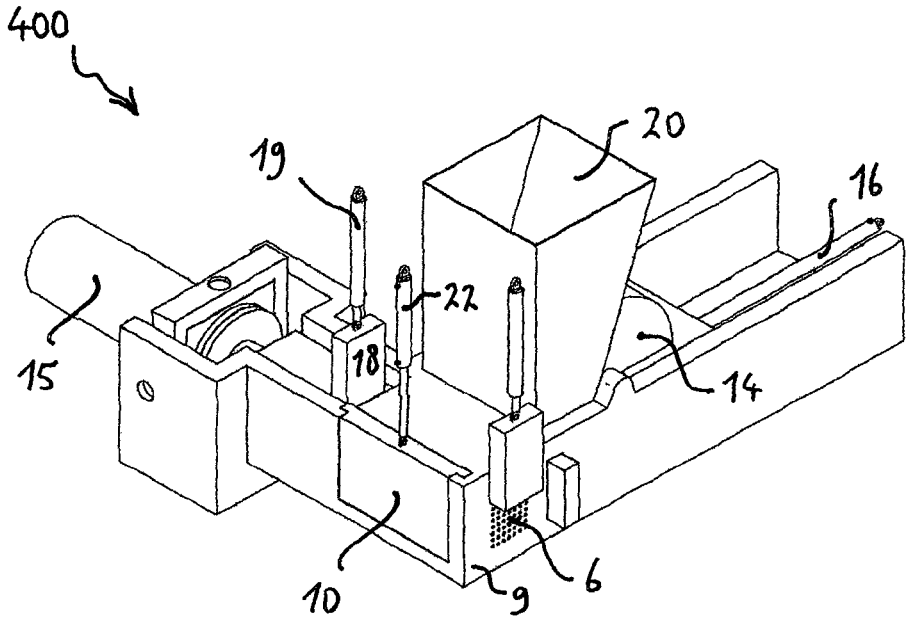
FIG. 10 shows a perspective view of a fourth exemplary embodiment of a device according to the invention.
Figure 11:
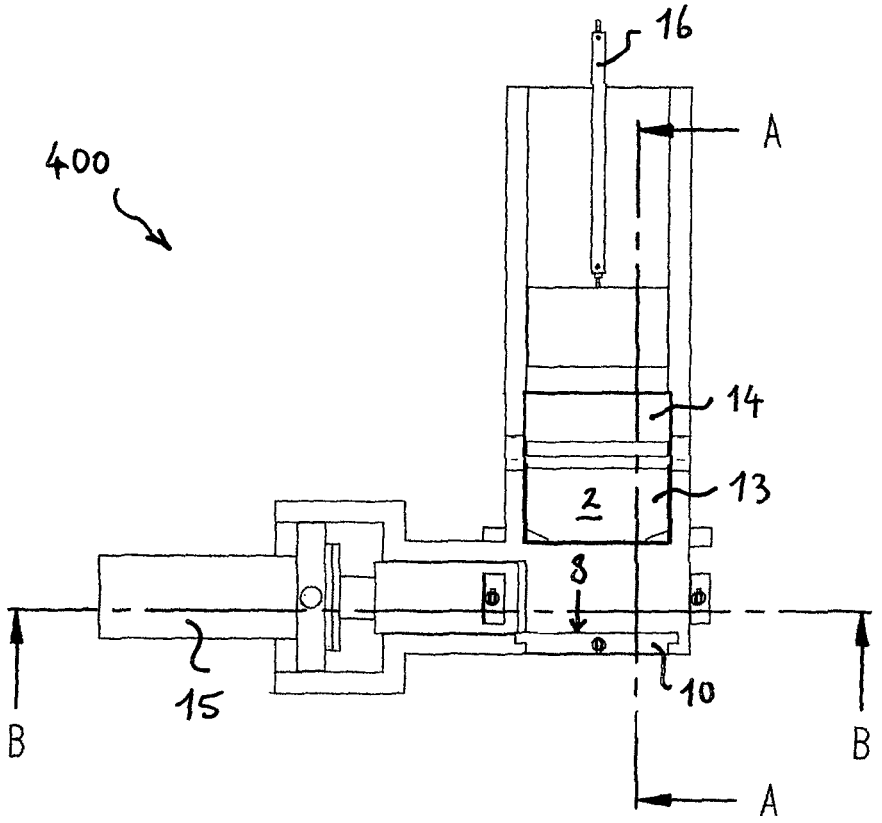
FIG. 11 is a top view of the device shown in FIG. 10.

The cross-section, i.e. the active cross-section perpendicularly of the direction of movement, of second plunger (12) is the same as the cross-section of discharge opening (8). All waste compacted in pressing chamber (3) can in principle thus be removed from pressing chamber (3) via discharge opening (8) by means of second plunger (12) when sliding door (10) is opened and first plunger (4) is in its first extreme position (as shown in FIG. 5). There is very little chance here of objects becoming jammed in device (200) or pressing chamber (3).

Device (200) also comprises a provision, here a slide (18) driven by means of a fourth hydraulic cylinder (19), for discharging pressed-out organic material, present here in a space (17) provided for this purpose in first plunger (4). Device (200) can comprise more of such provisions (not shown), for instance also for the purpose of removing pressed-out material in the vicinity of the perforated wall (9).

Device (300) shown in FIGS. 6-9 once again comprises the same components as devices (100;200) shown in FIGS. 1-5. Second feed opening (2) and first feed opening (5) now however coincide and are now situated at another location, i.e. immediately above pressing chamber (3), and bound pressing chamber (3). It could also be stated that the volume of the infeed chamber is now zero. The strokes made by first plunger (4) and second plunger (12) are now both minimal, which again has advantages, for instance in respect of simplicity of construction, processing capacity, wear and the space and energy required. Device (300) now also comprises a second door for opening and closing the combined feed opening (2,5), here a pivoting door (14), although this can for instance again be a sliding door. A pivoting door is generally recommended because parts protruding outside pressing chamber (3) are hereby pushed inward during closing of door (14) and cannot therefore become jammed during the movement of second plunger (12). A partial pre-compaction also takes place here.

Figure 12:
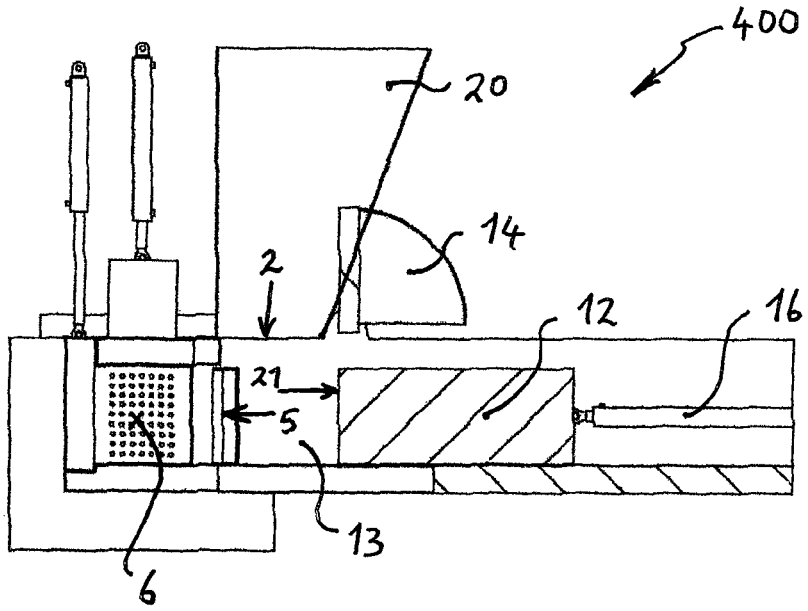
FIG. 12 is a vertical section of the device shown in FIG. 10 along the plane A-A.
Figure 13:
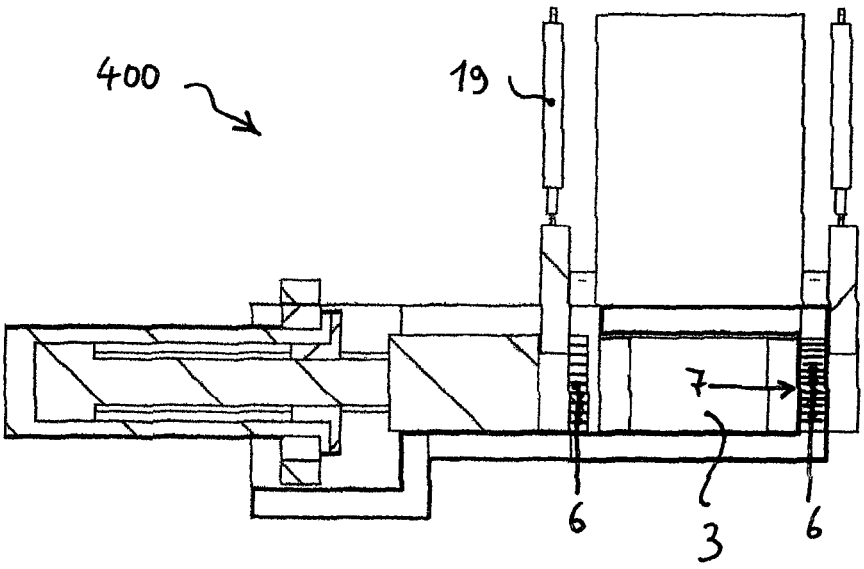
FIG. 13 is a vertical section of the device shown in FIG. 10 along the plane B-B.

Device (400) shown in FIGS. 10-13 again comprises the same components as devices (100;200;300) shown in FIGS. 1-9. Second feed opening (2), first feed opening (5) and infeed chamber (13) are again now situated at other locations. In the first extreme position (shown in FIG. 12) infeed chamber (13) is now situated between pressing surface (21) of second plunger (12) and first feed opening (5). By means of second plunger (12) the waste fed via second feed opening (2) into infeed chamber (13) is fed through further to pressing chamber (3) via first feed opening (5), and again pre-compacted here. Device (300) also again comprises a second door, now for opening and closing the second feed opening (2), here again a pivoting door (14). During closing of the door (14) parts protruding outside infeed chamber (13) are again pushed inward so that they cannot become jammed during the movement of second plunger (12). A partial pre-compaction again also takes place here.

In a device (200;400) according to the invention comprising an infeed chamber (13) located between second feed opening (2) and the first feed opening the waste is not fed directly into pressing chamber (3) but via infeed chamber (13). In addition to the stated advantages of pre-compaction and limiting the stroke required by first plunger (4), this also has structural advantages. The walls of pressing chamber (3) then have fewer openings, whereby they can better absorb the great forces exerted thereon.

Operation with a device (100;200;300;400) according to the invention can take place as follows. Perforations (6) have for instance a size of 4 to 8 mm. When during pressing a desired final pressure of for instance between 200-300 bar has been reached, first plunger (4) can be moved back. Discharge opening (8) can subsequently be opened by sliding away the sliding door (10) present in a side wall of pressing chamber (3). The remaining solid material can then be pressed out of pressing chamber (3) from an opposite side wall of pressing chamber (3) by means of second plunger (12). Plungers (4,12) then return to their rest positions (first extreme positions) and sliding door (10) is closed for the following cycle. The organic material pressed through perforations (6) is collected and carried away, optionally using additional plungers or slides.

Owing to the relatively high pressure, whereby the cell walls break and the organic material becomes more pasty and fluid, but also due to pressing through the relatively small perforations (6), very few interfering substances will be present in the pressed-out material. Stainless steel objects, such as knives and forks, which cannot be removed in a magnetic pre-processing, will thus not appear in the pressed-out material. The pressed-out material will also be greatly reduced in size as it passes through the relatively small perforations, and the proportion of glass and sand will decrease, as will the proportion of plastics. As a result of all this it will be possible to digest the pressed-out material much more easily, completely and rapidly, wherein downtime caused by interfering substances is limited to a minimum.

What remains in the pressing chamber after pressing is largely free of organic material and moisture. The remaining material has a greatly reduced moisture content, whereby the calorific value is greatly increased. Because the remaining material is relatively dry, it can also be further separated more easily since dry material adheres less than moist material. Owing to the relatively simple construction with a pressing chamber which is wholly closed during pressing and with few moving parts, the device is robust. It has also become easier to replace wearing parts, such as the perforated parts. The drives and guides of the plungers are loaded less than in known devices.

It will be apparent that the invention is not limited to the shown and described exemplary embodiments but that diverse variants which will be obvious to a skilled person are possible within the scope of the invention. In addition to being used for pressing organic material out of waste, the invention can also be applied for pressing another softer, more deformable or liquid fraction from a mixture also comprising a more solid and less deformable fraction.

The invention claimed is:

1. A device for pressing organic material out of waste, comprising:

a pressing chamber and a first pressing member for compacting introduced waste, wherein the first pressing member is movable in a first horizontal pressing direction;

a first feed opening for feeding waste into the pressing chamber;

perforations for allowing air, moisture and organic material pressed out of introduced waste to escape from the pressing chamber, which perforations are arranged in a fixed vertical wall of the pressing chamber and debouch in a surface bounding the pressing chamber; and a discharge opening for discharging from the pressing chamber compacted waste from which air, moisture and organic material are at least partially removed, a second pressing member movable into the pressing chamber for discharging compacted waste out of the pressing chamber through the discharge opening, wherein the second pressing member is movable in a second horizontal pressing direction, wherein the vertical fixed wall lies perpendicularly to the first horizontal pressing direction of the first pressing member and introduced waste is compacted against the vertical fixed wall by the first pressing member, a second feed opening for feeding waste into the device; and an infeed chamber, which infeed chamber is located between the first feed opening and the second feed opening, wherein in a first extreme position of the second pressing member, the infeed chamber is situated between the pressing surface of the second pressing member and the first feed opening such that waste in the infeed chamber is fed to the pressing chamber via the first feed opening by means of the second pressing member.

2. The device as claimed in claim 1, wherein perforations for allowing air, moisture and organic material pressed out of introduced waste to escape from the pressing chamber are also arranged in the first pressing member.

3. The device as claimed in claim 1, wherein the first pressing member comprises a first plunger.

4. The device as claimed in claim 1, wherein the second pressing member comprises a second plunger.

5. The device as claimed in claim 1, wherein the second pressing direction of the second pressing member lies perpendicularly of the pressing direction of the first pressing member.

6. The device as claimed in claim 1, wherein the cross-section of the second pressing member is the same as the cross-section of the discharge opening.

7. The device as claimed in claim 1 wherein the device also comprises a first door for opening and closing the discharge opening.

8. The device as claimed in claim 7, wherein the first door comprises a sliding door with a sliding direction perpendicularly of the second pressing direction of the second pressing member.

9. The device as claimed in claim 1, wherein the device also comprises a second door for opening and closing the second feed opening.

10. The device as claimed in claim 1, wherein the device also comprises a second door for opening and closing the second feed opening.

11. The device as claimed in claim 9, wherein the second door comprises a pivoting door.

12. A method for pressing organic material out of waste by means of a device comprising:

a pressing chamber and a first pressing member for compacting introduced waste, wherein the first pressing member is movable in a first horizontal pressing direction;

a first feed opening for feeding waste into the pressing chamber;

perforations for allowing air, moisture and organic material pressed out of introduced waste to escape from the pressing chamber, which perforations are arranged in a vertical fixed wall of the pressing chamber and debouch in a surface bounding the pressing chamber;

a discharge opening for discharging from the pressing chamber compacted waste from which air, moisture and organic material are at least partially removed;

a second pressing member movable in a second horizontal direction into the pressing chamber for discharging compacted waste from the pressing chamber through the discharge opening;

a second feed opening for feeding waste into the device; and an infeed chamber, which infeed chamber is located between the first feed opening and the second feed opening, which infeed chamber in a first extreme position of the second pressing member is situated between the pressing surface of the second pressing member and the first feed opening, the method comprising of:

feeding waste into the infeed chamber via the second feed opening;

displacing waste fed into the infeed chamber to the pressing chamber via the first feed opening by means of the second pressing member;

compacting introduced waste in the pressing chamber against the vertical fixed wall by means of the first pressing member moving in the first horizontal pressing direction perpendicularly to the vertical fixed wall;

allowing air, moisture and organic material pressed out of introduced waste to escape from the pressing chamber via the perforations; and discharging compacted waste from the pressing chamber via the discharge opening by means of the second pressing member, wherein pressing takes place by means of the first pressing member moving in the first horizontal pressing direction perpendicularly to the vertical fixed wall.

* * * * *